United States Patent [19]

Mougin

[11] 4,175,887

[45] Nov. 27, 1979

[54] ANTI-SWELL PROTECTIVE DEVICE

[75] Inventor: Georges L. Mougin, Paris, France

[73] Assignee: ITI Limited, Paris, France

[21] Appl. No.: 877,845

[22] Filed: Feb. 15, 1978

[30] Foreign Application Priority Data

Oct. 3, 1977 [FR] France ..... 77 29629

[51] Int. Cl.[2] ..... E02B 3/00

[52] U.S. Cl. ..... 405/25; 405/28; 405/211

[58] Field of Search ..... 61/5, 102, 3, 4, 2, 61/1

[56] References Cited

U.S. PATENT DOCUMENTS 3,222,870 12/1975 Miller et al. ..... 61/5

3,436,920 4/1969 Blenkarn et al. ..... 61/102 X 3,785,159 1/1974 Hammond ..... 61/5

*Primary Examiner*—Jacob Shapiro

*Attorney, Agent, or Firm*—George E. Kersey

[57] ABSTRACT

A device for protecting off-shore structures stretched between two floating towers of the "Froude pole" type against the effects of ocean swell, comprising at least four floating poles, two vertical arrays of horizontal cables, and a deflection panel assembly attached to one of the vertical arrays of horizontal cables. The floating poles comprise a rigid metal structure between two metal cylinders of the same diameter. The vertical arrays of horizontal cables form opposed catenary curves and are braced by further horizontal cables extending between them.

10 Claims, 5 Drawing Figures

Fig. 2
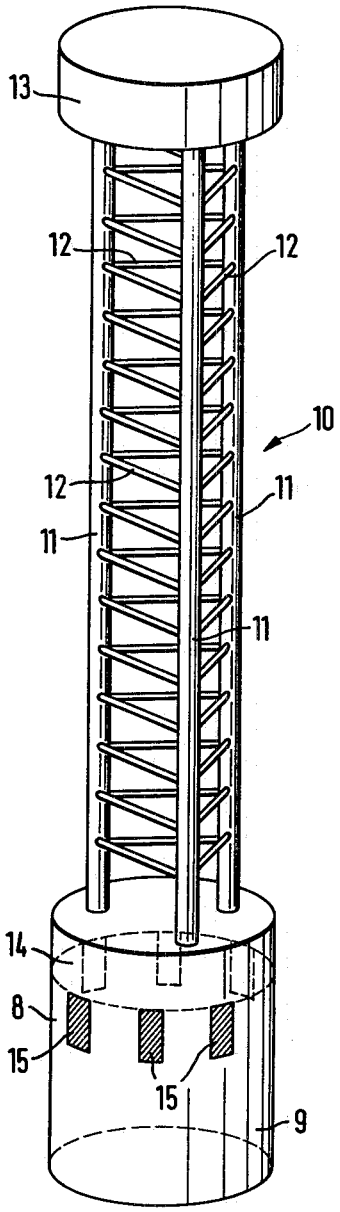
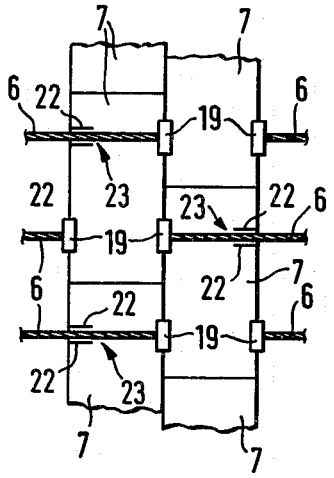
Fig. 4

ANTI-SWELL PROTECTIVE DEVICE

The present invention concerns a device for protecting off-shore structures against the effects of the ocean surface, especially swell and the lapping of the waves.

Various protective devices have been proposed in the prior art, including a wave-breaking wall incorporating JARLAN holes and used to protect a blind wall. This kind of device is used for off-shore oil rigs, but has not proved as effective as had been hoped. Devices of this kind can be difficult to install when the structure does not stand on the sea bed, as in the case of structures in areas where the depth of the ocean is several hundred meters. In such cases the protective device must be a floating one.

A floating protective device is essential for tabular icebergs during towing or when they have been moored for use, as otherwise there is the risk that the waves will erode away the ice around the water line. This can form ice caves which cause blocks of ice to fall into the sea. These blocks come away from the vertical side faces of the iceberg, which can have a height of up to 40 meters above the water line, and represent a hazard to shipping. This effect is produced more rapidly in tropical waters, where the sea water in which the tabular iceberg floats is much warmer than that of the Antartic. For this reason it is important to protect the iceberg from this mechanical action and from the violent movement of the ocean surface.

To this end the present applicants have previously proposed the use of a protective device consisting of a ring of juxtaposed reinforced concrete towers. It would be advantageous for the protective devices to be lighter, less bulky, and of variable length.

Preferred embodiments of the present invention provide a protective device which is more compact, which floats, which can be assembled with other like devices to protect any desired length, and which is capable of absorbing the energy of the waves or the swell.

In use the device is intended to be stretched between two floating towers which are constructed, for example, in accordance with the applicants' French patent application No. 7,728,859. The invention comprises two vertical arrays of horizontal cables stretched between the two floating towers, a first one of the arrays supporting an assembly of deflection panels and the other array serving to brace the first array against movement in a direction generally perpendicular to its plane. Preferably each end of the arrays is secured to a vertical pole (which may be a floating pole of the Froude pole type) which is held against one of the towers in use. If the poles are floating poles they should have sufficient buoyancy to support the device before it is put in place against the towers, but poles attached to the towers from the start could alternatively be used. In a preferred embodiment at least a fifth floating pole is located in between the end poles (whether floating poles or not) to support the weight of the protective device in mid span. The horizontal cables can be tensioned by applying tractive effort to ties which connect the vertical poles of one device to the corresponding poles of adjacent devices which are held against the same tower.

The deflection panels have the general shape of a stackable chair with the legs removed. Thus their cross-section in a vertical plane perpendicular to their surface has the form of an epicycloid with a generally horizontal seat part facing the waves and deflecting them upwardly along the more vertical back part. The horizontal cross-section is substantially the shape of a basket-handle arch. Each panel has four support points each of which co-operates with a support point of a different adjacent panel, the panels are staggered tile-like so the upper left support point of one co-operates with the lower right of another, and an upper right with a lower left. The upper support points are on the front surfaces of the panels and are arranged on either side of a horizontal groove for accommodating one of the horizontal cables of the array. The lower support points are in the form of backwardly projecting feet whose soles "stand" on the upper support points with which they co-operate, thereby locking the cables in the grooves. The distance between adjacent horizontal cables is at least equal to half the height of the panels.

As an alternative to the ties mentioned above, the vertical arrays could be tensioned by moving the floating towers themselves. It should be noted that sea water can circulate horizontally only in a direction parallel to the vertical array supporting the deflection panels.

The invention will now be described in more detail, by way of example only and with reference to the accompanying drawings, in which:

FIG. 2 is a perspective view of a floating pole;

FIG. 4 is a partial front view of the deflection panels of the device; and

A protective device in accordance with the invention is associated with two floating towers comprising deflection rings mounted above a ring of buoyancy tanks enclosing a pneumatic damper bell and having a ballast weight at their lower ends. The amplitude of the vertical movement of these towers is less than 20% of the maximum swell amplitude if the submerged height of the tower is less than 150% of the maximum swell amplitude and the height of the portion above the water is at least 33% of the maximum swell amplitude. These floating towers are highly stable.

Figure 1:
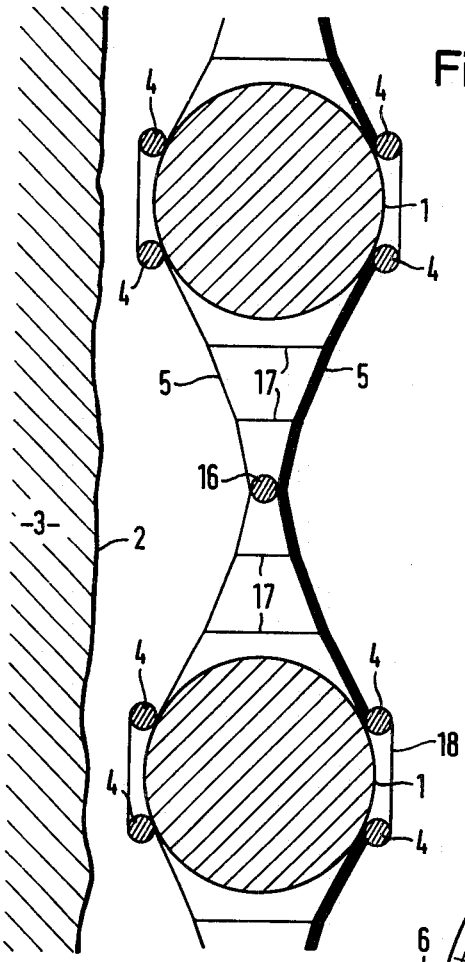
FIG. 1 is a plan view of a protective device in accordance with the invention.

FIG. 1 is a schematic plan view of a protective device in accordance with the invention, stretched between two floating towers (1) of the type described above. The function of the device is to prevent the full force of the waves being exerted on the vertical side wall (2) of a tabular iceberg (3). The floating towers (1) are 40 to 80 meters apart and between them are at least four floating poles (4) of the "Froude pole" type, two vertical arrays (5) of horizontal cables (6) and a set of deflection panels (7) attached to the array (5) furthest from the tabular iceberg (3).

The floating poles (4) support the two vertical arrays (5) of horizontal cables (6). The centre of buoyancy of each pole (4) is beneath the water line, at a depth which is greater than half the height of the swell, but is nevertheless well above the centre of gravity, by virtue of the ballast weight at the bottom. As a result the poles are highly stable, in spite of the movement of the ocean surface. The floating poles (4) may have a height of 50 meters, and each of them comprises, as shown in FIG. 2, a metal cylinder (8) with a diameter of 1 to 2 meters and a length of 10 to 20 meters, providing a buoyancy tank (14) and containing or supporting a ballast weight (9) at its lower end. Openings (15) in the cylinder (8)

enable seawater to enter the lower portion of the floating pole (4); mounted on the cylinder (8) is a rigid metal structure (10) which is low in volume and has a height at least equal to the amplitude of the swell on either side of the water line in the rest position. The metal structure (10) comprises three tubes (11) and crossbraces (12) and is topped with a cylindrical cap (13) with the same diameter as the metal cylinder (8). This enables a floating pole (4) in contact wih a vertical surface to remain upright. As shown in FIG. 1, a floating pole (4) is placed at each end of each of the vertical arrays (5) of horizontal cables (6). The fifth floating pole (16) is placed between the two vertical arrays (5) of horizontal cables (6). Its function is to support the weight of the cables and deflection panels above the water surface. The end floating poles (4) bear against the opposite sides of the floating towers (1), so that the two vertical arrays (5) of horizontal cables (6) form opposed catenary curves which meet at the pole (16). The two arrays (5) are braced by horizontal cables (17) which extend between them.

The arrays (5) of horizontal cables (6) are stretched between the metal structures (10) which form the central portions of the floating poles (4). The cables are of steel or a low-density synthetic material, and must be capable of withstanding the stresses imposed by the pressure exerted on the panels (7) by the waves. They are about one meter apart, which is about half the height of a panel (7), as can be seen from FIGS. 2, 3 and 4. Each panel (7) is attached to two adjacent horizontal cables (6), at four support points.

The deflection panels (7) are curved, their cross-section in the vertical plane perpendicular to their surface being an epicyclic curve. This shape converts the horizontal movements of the water surface into upward movements. Thus the greater the inertia of the waves, the higher they are projected by the deflection panels. The energy of the waves is dissipated in overcoming the force of gravity. The panels (7) are about two meters high and one meter wide. Smaller dimensions may be used, and the panel dimensions are limited by the method used to manufacture the panels (press dimensions in the case of metal panels and mould dimensions in the case of plastics panels).

Figure 3:
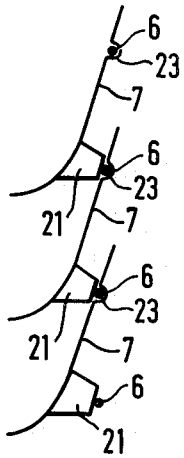
FIG. 3 is a partial cross-section through the device in a vertical plane.
Figure 5:
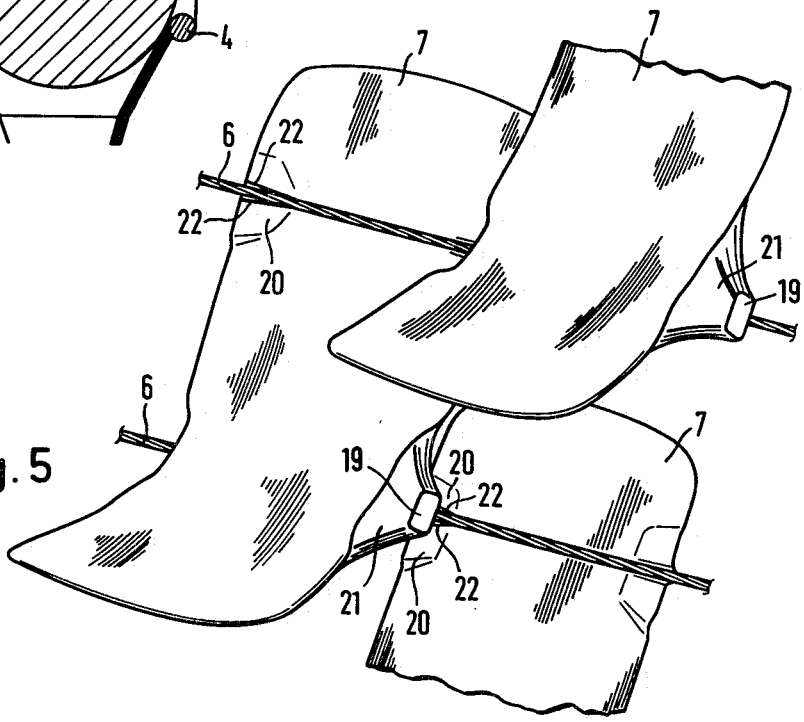
FIG. 5 is a partial perspective view of the deflection panels.

The panels (7) are mounted in alternating fashion on the vertical arrays (5) of horizontal cables (6), adjacent panels (7) being staggered by half a panel height. The panels (7) are attached to the horizontal cables (6) by connecting the lower feet (21) of one panel to the edges (22) of the upper grooves (23) of the adjacent lower panels, with the horizontal cables (6) being contained in these grooves (23). As shown in FIG. 3, this method of assembly traps the horizontal cables (6) between the feet (20) and the grooves (23) of associated pairs of deflection panels (7). The vertical distance between the feet (20) and the grooves (23) on each panel (7) is the same as the vertical spacing between the horizontal cables (6) of the arrays. The feet (20) and the groove edges (22) are rigidly fixed together by any suitable known means. The panels (7) are immobilised by tensioning the device, with the two vertical arrays pulling against each other to prevent horizontal movement of the panels (7).

The horizontal cross-section of the panels (7) is also curved to stiffen the panels. As a result the grooves (23) do not extend right across the panels (7). The feet (21) are formed by rectangular or trapezoidal projections, and the sole (19) of each foot is offset relative to the body of the panel (7), and substantially parallel to the surface of the associated panel in the vicinity of its groove edges (22). This part of each panel (7) may protrude slightly, to facilitate joining the panels together.

It should be noted that the vertical projection of the assembly of panels (7) parallel to the protective device (i.e. parallel to the vertical side face (2) of the protected tabular iceberg (3)) does not include any openings. This prevents horizontal movement of the sea water perpendicular to the protective device. The sea water can circulate horizontally only in a direction parallel to the protective device, in other words parallel to the vertical arrays (5).

The protective device in accordance with the invention is tensioned by moving apart the floating poles (4) which support the device before it is installed. The poles (4) are slid along the wall of the floating towers (1), the end poles (4) of adjacent devices thus approaching one another. Thus the tensioning may be achieved by drawing the end poles (4) of adjacent devices together by applying tractive effort to ties (18) connecting them together, using a winch mounted on the cap (13) of one of the poles (4). The poles (4) bear against the floating towers (1), which hold them apart. In the case of a floating tower (1) at the end of a run of devices, the ties (18) may be attached to the tower.

What is claimed is:

1. A device for protecting an off-shore structure from the effects of ocean swell, the device being stretched, in use, between two floating towers, wherein the device comprises two vertical arrays of horizontal cables stretched between the two floating towers, a first one of the arrays supporting an assembly of deflection panels and the other array serving to brace the first array against movement in a direction generally perpendicular to its plane.

2. A device according to claim 1, wherein each end of the arrays of horizontal cables is secured to a vertical pole which is held against one of the towers, in use.

3. A device according to claim 2, wherein the said poles are floating poles with sufficient buoyancy to support the device before it is installed between the two floating towers.

4. A device according to claim 3, wherein each of the said floating poles to which the horizontal cables are secured, comprises a rigid metal structure extending between two metal cylinders of the same diameter, the lower cylinder containing a buoyancy tank which is located above a ballast weight.

5. A device according to claim 3, further including at least a further floating pole located between the two arrays of horizontal cables to support the weight of the cables and the deflection panels.

6. A device according to claim 2, wherein the horizontal cables are tensioned by applying tractive effort to ties interconnecting the vertical poles at the ends of the vertical arrays to the corresponding vertical poles of adjacent devices.

7. A device according to claim 1, wherein the deflection panels are curved in such a way that their cross-section in a vertical plane perpendicular to their surface has the form of an epicycloid.

8. A device according to claim 7, wherein the cross-section of the deflection panels in a horizontal plane has substantially the shape of a basket-handle arch.

9. A device according to claim 8, wherein each deflection panel has four support points, each point co-operating with one of the support points of a different adjacent panel.

10. A device according to claim 9, wherein the horizontal cables of the vertical arrays are gripped between said co-operating pairs of support points.

* * * * *